United States Patent [19]

Smith et al.

[11] 4,158,510

[45] Jun. 19, 1979

[54] CEMENTING SKID WITH RECIRCULATING MIXER

[75] Inventors: Lance G. Smith; Jerry N. Knoll, both of Duncan, Okla.

[73] Assignee: Halliburton Company, Duncan, Okla.

[21] Appl. No.: 889,783

[22] Filed: Mar. 24, 1978

[51] Int. Cl.[2] ..... B01F 15/00

[52] U.S. Cl. ..... 366/16

[58] Field of Search ..... 366/16–21; 108/51.1, 55, 55.5; 175/219; 193/41; 248/2, 19, 20, 23

[56] References Cited

U.S. PATENT DOCUMENTS

| | | | |
|---|---|---|---|
| 1,551,551 | 9/1925 | French | 248/19 |
| 1,970,705 | 8/1934 | Montigney | 248/19 |
| 3,908,967 | 9/1975 | Merritt | 366/17 |

*Primary Examiner*—Leonard D. Christian

*Attorney, Agent, or Firm*—John H. Tregoning; James R. Duzan

[57] ABSTRACT

A machinery skid unit comprising a machinery skid frame including a plurality of longitudinal frame members, cross-members mounted thereon and extending outwardly therefrom and a plurality of members secured to said longitudinal frame members in a horizontal plane below the cross-members. The machinery skid unit further comprises a plurality of engines, a plurality of positive displacement type pumps, a recirculating mixing system, a supply pump, and a recirculating pump.

24 Claims, 6 Drawing Figures

CEMENTING SKID WITH RECIRCULATING MIXER

This invention relates to an improved machinery skid unit. More specifically, the invention relates to an improved machinery skid unit for use in well cementing and pumping operations, the machinery skid frame thereof and the spatial relationship of the equipment mounted thereon.

In the past, machinery skid units were constructed being generally rectangular in shape and comprised of one or more rectangular frames with the equipment mounted thereon located within the peripheral limits of its rectangular frame and in a generally common horizontal plane to allow the various components and their accessories each to be driven directly from an engine, or engine and transmission combination. In many instances, in such rectangular frame type skid units the components and accessories are also normally mounted having portions of the components and accessories extending into the rectangular skid frame.

While rectangular frame type machinery skid units are easily constructed, they have several undesirable features. For instance, access for the servicing of the skid unit components and their accessories is limited since many parts of the components and their accessories extend into the rectangular skid frame or are obscured by it. Another undesirable feature results from having each component on the rectangular skid unit independently directly driven by its own power source thereby necessitating the use of multiple power sources. Also, since each power source and its associated component are normally mounted within its own rectangular frame in the skid unit, the number of rectangular frame members utilized to fabricate the skid unit, the weight of the skid unit and the area occupied by the skid unit are greatly increased.

In this connection, it must be emphasized that the weight of a skid unit and, particularly, the area the skid unit occupies are critical in well cementing and pumping operations conducted at offshore locations since the available floor area on the drilling vessel is extremely limited and the means of transporting the machinery skid unit to the offshore location are limited to either air or sea transportation. Unduly bulky skid units create handling and shipping problems during transportation to and from the offshore location while further creating problems in clearing or providing enough drilling vessel floor area on which to install the skid unit.

In contrast to the prior art rectangular frame type skid units, the present invention comprises a machinery skid frame and component arrangement thereon which allows ready access for the servicing of the skid unit components and their accessories, which permits the use of directly and indirectly driven components thereby reducing the number of power sources required to operate the various components mounted upon the skid frame and the skid unit's weight, which utilizes a skid frame design that reduces the number of skid frame members thereby reducing the weight of the skid frame, and which facilitates a more compact arrangement of the components on the skid unit thereby reducing the area occupied by the skid unit and the skid unit's weight. A preferred embodiment of the machinery skid frame of the present invention comprises a pair of longitudinal frame members located in close proximity to each other having a plurality of crossmembers secured thereto, some of which extend above and beyond the longitudinal frame members to allow complete or partial mounting of the various components and power sources outboard of the longitudinal frame members thereby allowing easy access to the components and power sources for the servicing thereof and a compact, minimum weight machinery skid and machinery skid configuration which occupies a minimum of physical area.

The foregoing advantages and the preferred embodiment of the invention will be better understood from the following specification taken in conjunction with the accompanying drawings wherein.

Figure 1:
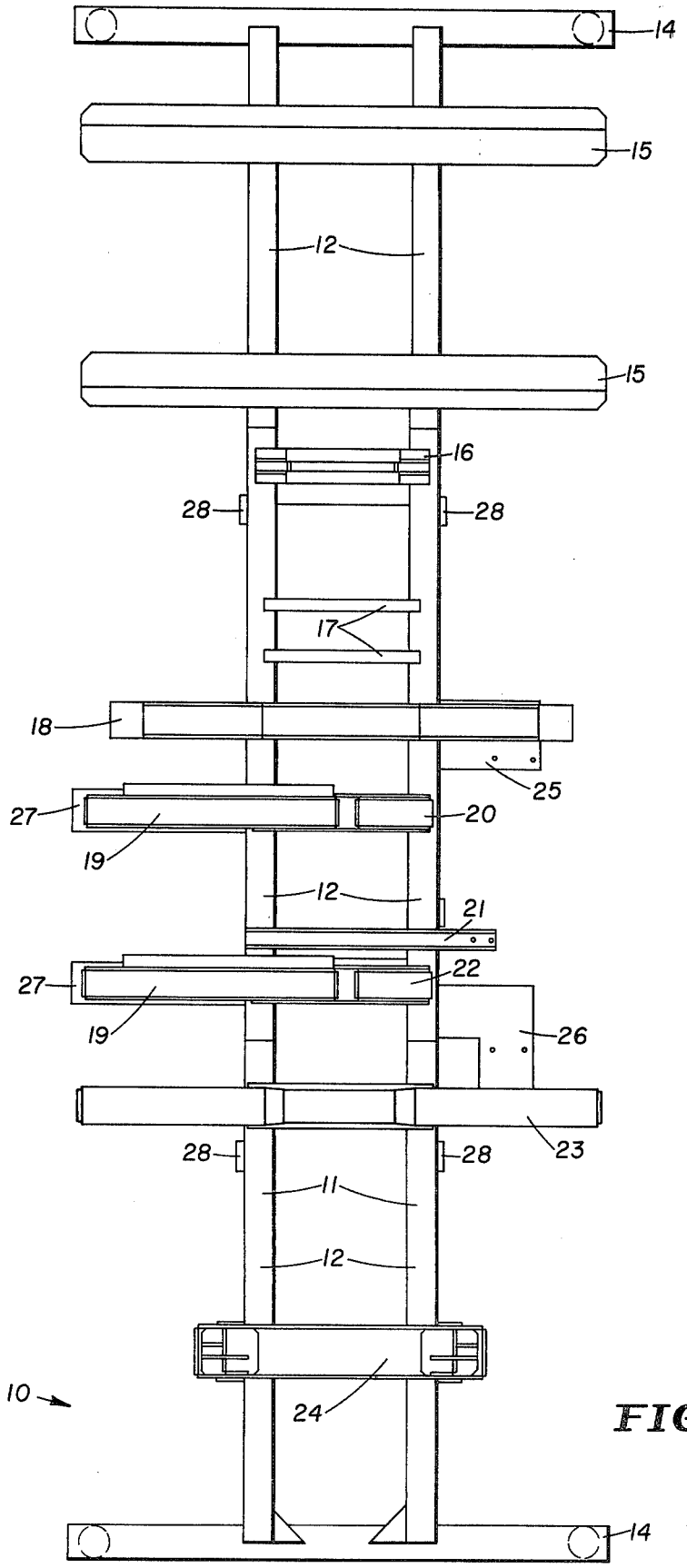
FIG. 1 is a top view of the skid frame according to a preferred embodiment of the present invention.

Referring to FIG. 1, the preferred embodiment of the machinery skid frame 10 of the present invention is shown.

The machinery skid frame 10 comprises a pair of longitudinal frame members 11 and a plurality of cross-members upon which various components (not shown) are mounted. The longitudinal frame members 11 are each formed from a plurality of sub-frame members 12 which are releasably secured to each other by any suitable fastening means, such as threaded fasteners 13 (see FIG. 2). By forming the longitudinal frame members 11 from a plurality of sub-frame members 12, the machinery skid frame 10 can be broken into sections for shipping and handling during installation.

The various machinery skid frame cross-members comprise end cross-members 14, engine cross-members 15, the front support 16 for the measuring tank, fluid system component supports 17, the rear support 18 for the measuring tank, operator stand supports 19, the front recirculating cement mixing (RCM) system support 20, the intermediate RCM system support 21, rear RCM system support 22, front pump support 23, and rear pump support 24. The various cross-members may be secured to the longitudinal frame members 11 by any convenient fastening means, such as welding.

Also shown in FIG. 1, attached to the longitudinal frame members 11 installed in a horizontal plane below the other cross-members are water supply pump support 25, recirculating pump support 26 and auxiliary engine supports 27. The pump supports 25 and 26 and the auxiliary engine supports 27 are mounted outboard of the longitudinal frame members 11 and are secured thereto by any suitable fastening means, such as welding.

As shown, by locating the longitudinal frame members 11 in the central portion of the machinery skid 10 in close proximity to each other, rather than at the outer ends of the machinery skid frame cross-members, the various cross-members can easily be mounted on top of the longitudinal frame members 11 thereby allowing the machinery skid frame components to be installed above the longitudinal frame members for easy servicing while other components can be easily mounted outboard and along side the longitudinal frame members for easy access and servicing. Also, by having the longitudinal frame members 11 acting as a central spine of the machinery skid frame 10 with the various cross-members extending therefrom thereby allowing other components to be located outboard of the longitudinal frame members 11 and below components mounted on the various cross-members, the machinery skid unit 10 can be of a smaller size and weight than a comparable rectangular skid unit.

Figure 2:
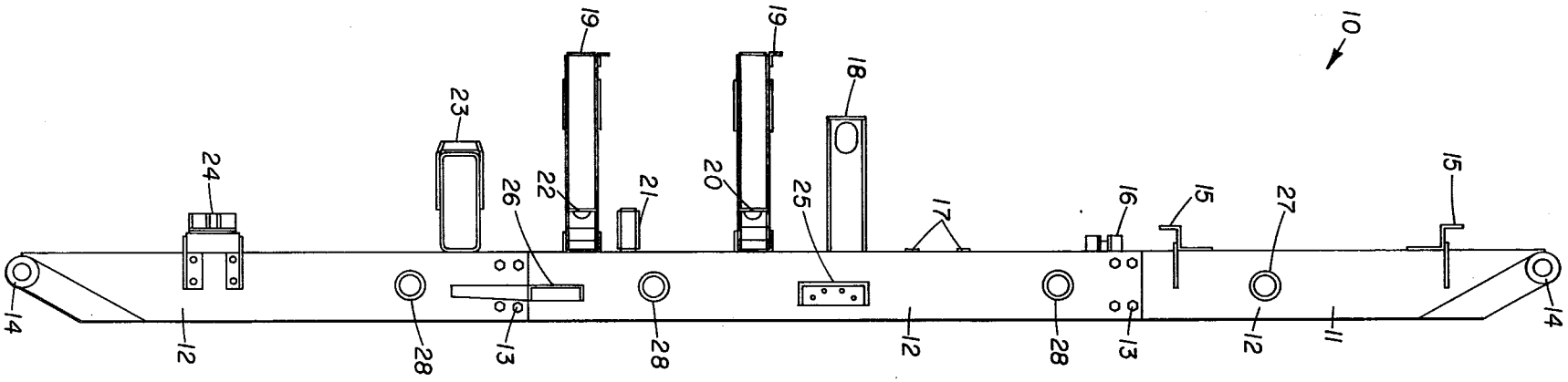
FIG. 2 is a view of the right side of the skid frame shown in FIG. 1.

Referring to FIG. 2, the right side of the machinery skid unit 10 is shown. As can be easily seen, the longitudinal frame members 11 are comprised of sub-frame members 12 secured together by fasteners 13. Also, as shown, the water pump support 25 and recirculating pump support 26 are located along side the longitudinal frame members 11 in a horizontal plane below the various machinery skid frame cross-members.

The longitudinal frame members 11 include lifting eyelets 28 at various locations therein to facilitate lifting of the machinery skid unit 10 or portions thereof.

Figure 3:
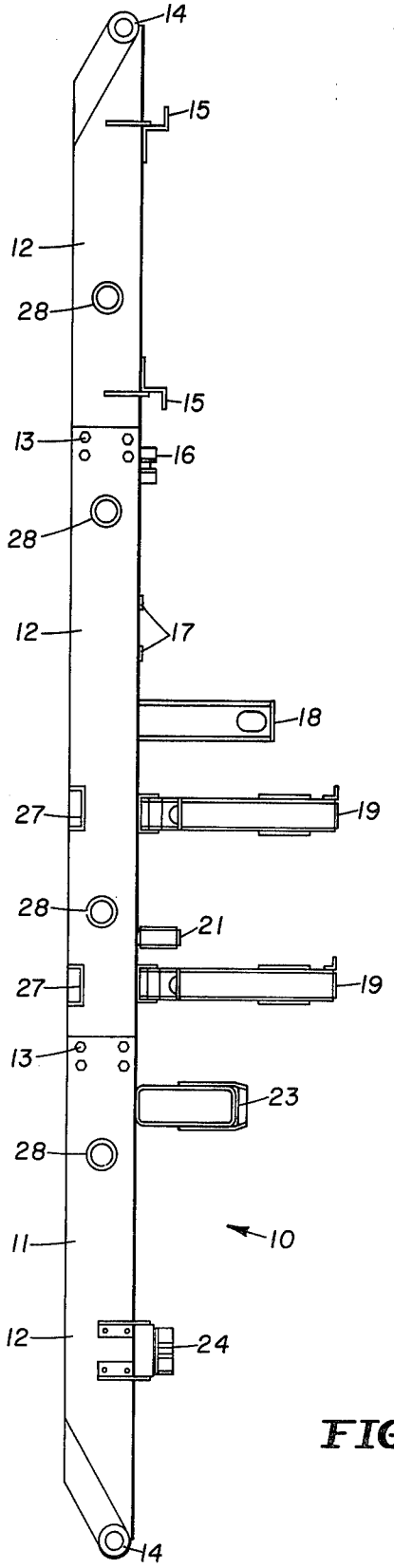
FIG. 3 is a view of the left side of the skid frame shown in FIG. 1.

Referring to FIG. 3, the longitudinal frame member 11 is shown. The longitudinal frame member 11 includes lifting eyelets 28 and auxiliary engine supports 27 secured to the longitudinal frame member 11 and mounted in a horizontal plane below the various machinery skid frame cross-members.

Figure 4:
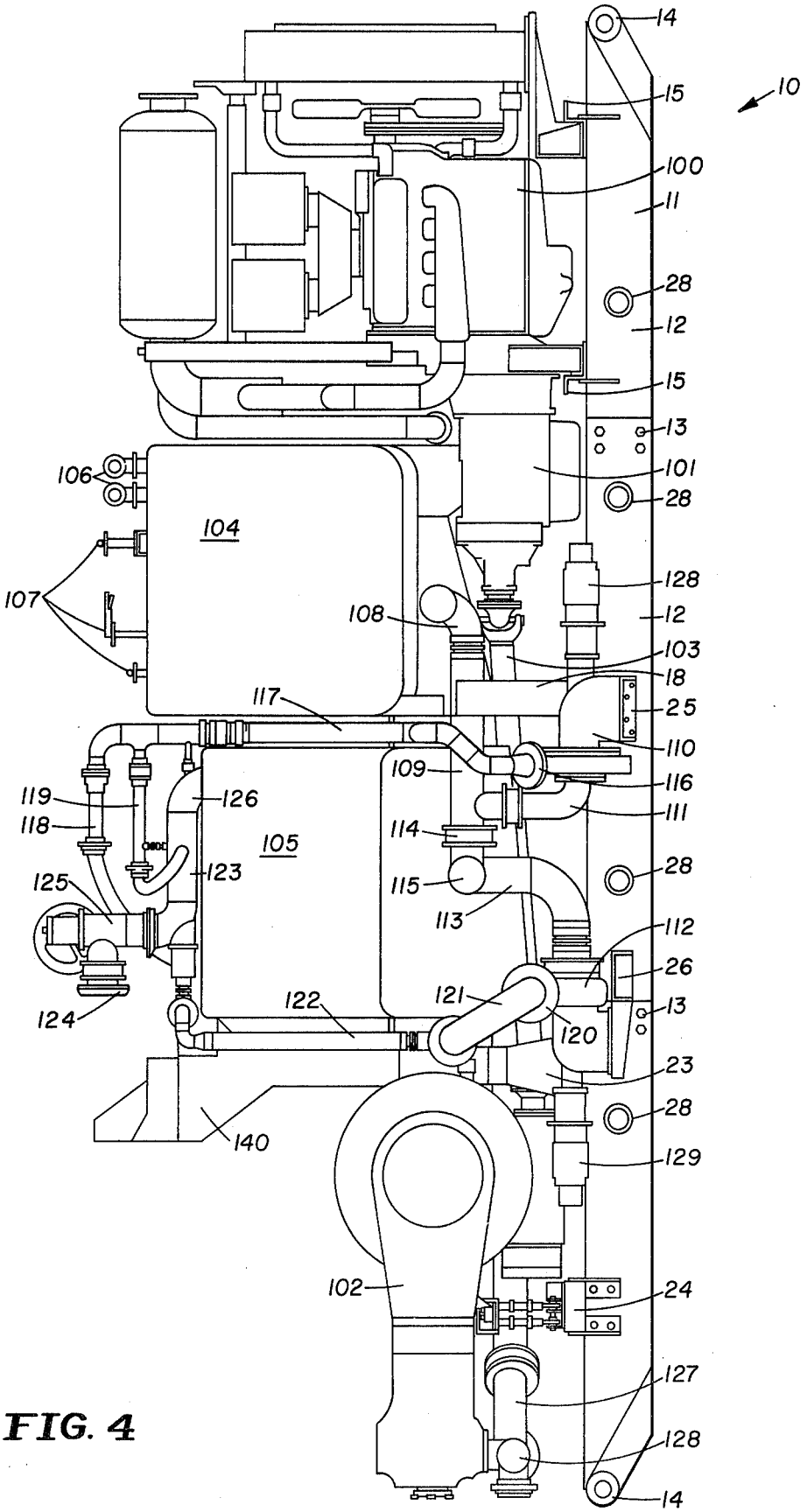
FIG. 4 is a view of the right side of the skid frame as shown in FIG. 2 having the components mounted thereon thereby forming a machinery skid unit.

Referring now to FIG. 4, the machinery skid frame 10 is shown having the various components mounted thereon thereby forming a machinery skid unit. As shown, an engine 100 having a transmission 101 connected thereto drives a positive displacement pump 102 via driveshaft 103. Any suitable engine, transmission and pump may be used or an electric motor which may or may not have a transmission attached thereto may be used to drive the pump. However, a Halliburton Services model HT-400 pump as described on page 3133 of Halliburton Services Sales and Service Catalog, Number 39, is the preferred type of positive displacement pump. A preferred type of engine and transmission is a Detroit Diesel, Model 8V-71 engine and an Allison, Model HT-750 DRD transmission which are both manufactured and sold by the Detroit Diesel Allison Division of General Motors Corporation.

Also mounted on the machinery skid frame 10 located between the engine 100 and pump 102 are measuring tank 104 and the recirculating cement mixing (RCM) system 105.

The measuring tank 104 is fed via inlet manifolds 106 and has a plurality of discharge valves (not shown) controlling the flow of fluid therefrom. The control handles 107 of the discharge valves can be seen extending above the measuring tank 104 for easy access. The discharge 108 of the measuring tank 104 is connected via measuring tank discharge manifold 109 to the inlet of water supply pump 110 by means of pump inlet line 111 and is connected to recirculating mixer pump 112 by means of recirculating mixer pump inlet line 113. The inlet of recirculating mixer pump 112 is also connected to the discharge 115 of the recirculating mixing system 105. A valve 114 controls the flow of fluid from measuring tank discharge manifold 109 to the recirculating pump inlet line 113.

The water supply pump exhaust 116 discharges into supply line 117, which, in turn, discharges into both recirculating mixer supply line 118 and recirculating mixer supply line by-pass 119.

The recirculating pump exhaust 120 discharges into discharge manifold 121, which, in turn, discharges into both recirculating mixer supply line 122 and cement discharge manifold 127.

Recirculating mixer supply line 118, supply line by-pass 119, and recirculating supply line 122 all supply recirculating mixer 123 with fluid or fluid mixed with cement. The recirculating mixer 123 is pneumatically supplied with cement through connection 124 and valve 125. The cement supplied through connection 124 and valve 125 is mixed with fluid supplied from supply line 118, supply line by-pass 119, and the mixture of fluid and cement supplied from recirculating supply line 122. The recirculating mixer 123 is a commercially available unit as sold by Halliburton Services and described on page 3134 of Halliburton Services Sales and Service Catalog, Number 39. Therefore, it will not be described in detail.

After initial mixing in the recirculating mixer 123, the cement and fluid mixture is discharged via line 126 into the recirculating cement mixing system 105. The recirculating cement mixing system 105 is a commercially available unit as described on page 3135 of Halliburton Services Sales and Service Catalog, Number 39. Therefore, it will not be described in detail.

During cement mixing operations, the recirculating cement mixer system 105 discharges into cement discharge manifold 17, which in turn, discharges into the suction manifold 128 of the positive displacement pump 102.

During normal cement mixing operations, valve 114 is closed thereby allowing water supply pump 110 to supply fluid from measuring tank 104 directly to the recirculating mixer 123 while recirculating pump 112 supplies a mixture of cement and fluid to the recirculating mixer 123. Alternately, by means of a control valve (not shown) the output of recirculating pump 112 can be entirely supplied to recirculating mixer 123 or only a portion thereof supplied to the recirculating mixer 123 while the remaining portion is discharged into cement discharge manifold 127.

The water supply pump 110 and recirculating pump 112 are driven by hydraulic fluid motors 128 and 129 respectively. The water supply pump 110 and recirculating pump 112 may be any suitable commercially available type of centrifugal pump capable of pumping a variety of fluids or slurries. Similarly, the hydraulic motors 128 and 129 which power the pumps 110 and 112 may be any suitable commercially available units. Preferred types of pumps and motors are Deming Model 4021 HD-5MD and Deming Model 4021 HD-44L pumps as manufactured and sold by the Deming Division of the Crane Company, and Sundstrand Model 21 Series motors which are manufactured and sold by Sundstrand Hydro-Transmission Division of the Sundstrand Corporation.

It should be noted that the water supply pump 110 and recirculating pump 112 are mounted along longitudinal frame member 11 and below measuring tank 104 and recirculating cement mixing system 105. This location allows easy access for maintenance, results in keeping the pumps completely flooded with fluid during pumping operations thereby almost completely eliminating pump cavitation problems, and allows a compact arrangement of the cement mixing system and manifolding therefore thereby eliminating unnecessary piping and manifolding.

In this connection, by mounting pump 102 on one end of the machinery skid frame 10 and its power source on the other end of the machinery skid frame 10, the pump 102 and its power source are readily accessible for servicing.

Figure 5:
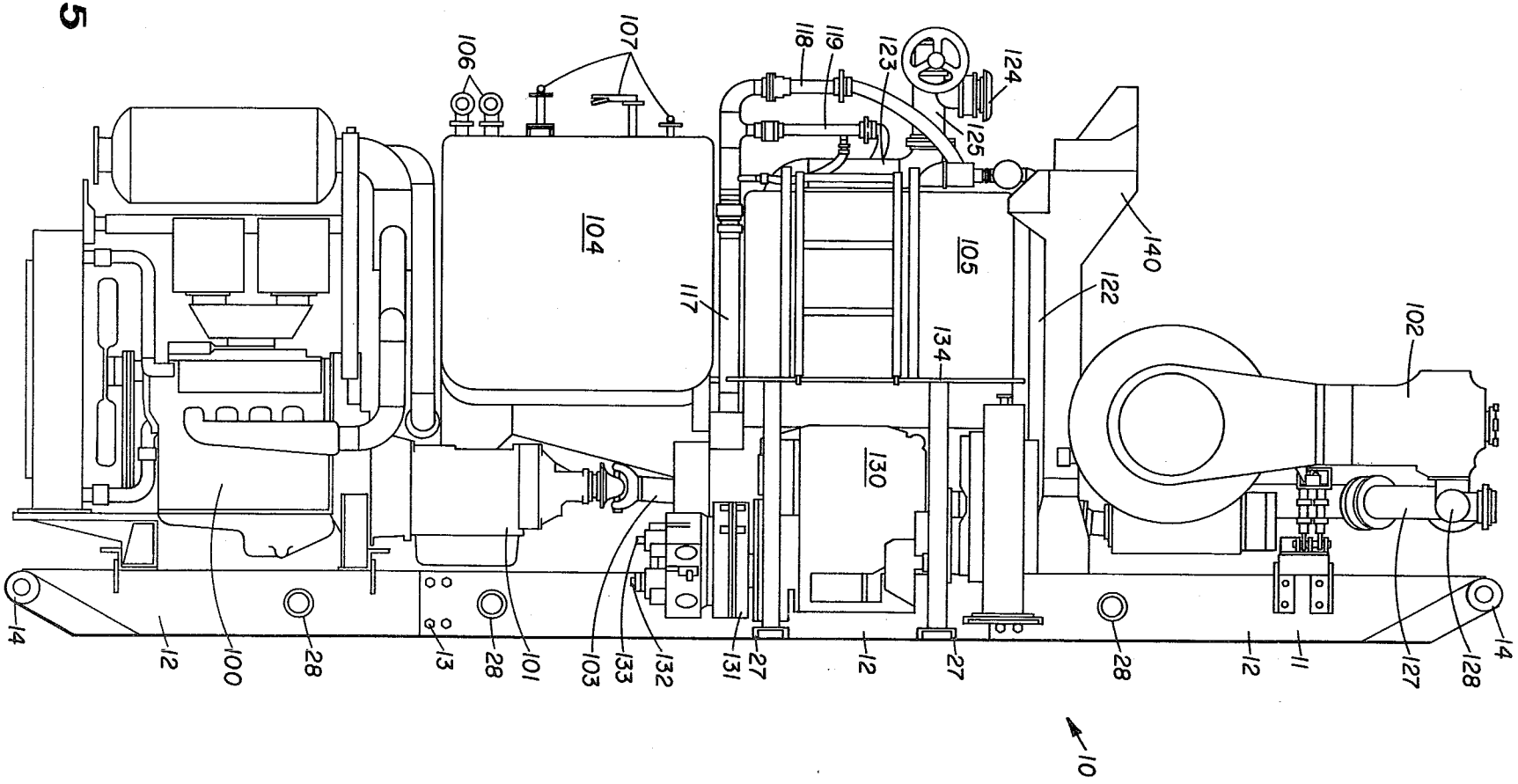
FIG. 5 is a view of the left side of the machinery skid unit as shown in FIG. 4.

Referring to FIG. 5, the operator's control stand 140, which contains the controls necessary to operate the various components of the machinery skid unit, is shown. Also shown in FIG. 5 is auxiliary engine 130. Auxiliary engine 130 is connected to gear box 131, which, in turn, has mounted thereon fluid pumps 132 and 133. Fluid pumps 132 and 133 independently supply fluid under pressure via lines (not shown) to drive fluid motors 128 and 129, which, in turn, power water supply pump 110 and recirculating pump 112 respectively. By utilizing independent fluid supplies to the fluid motors 128 and 129 by the fluid pumps 132 and 133 the speeds of the water supply pump 110 and recirculating pump 112 may be independently controlled, thereby allowing greater flexibility in the cement mixing process.

As shown, the auxiliary engine 130, gear box 131 and pumps 132 and 133 are mounted along side longitudinal frame member 11 and below the operator's platform 134, thereby allowing easy access to the engine, gear box and pumps for servicing. Also, by utilizing a fluid type drive for the water supply pump 110 and recirculating pump 112 only engine 130 is required to supply the necessary power to drive the pumps and allows the flexibility to locate the engine 130 in any desired location to maximize the use of the area occupied by the skid unit.

Any suitable commercially available engine 130, gear box 131 and fluid pumps 132 and 133 may be used to power the fluid motors 128 and 129. A preferred type of gear box and pumps is a Marco Model DP 26 gear box and as sold and manufactured by the Industrial Products Division of Marco, Seattle, Washington, and a Sundstrand Model 20 and 21 Series pumps as manufactured and sold by Sundstrand Hydro-Transmission a Division of the Sundstrand Corporation.

It should be noted that the agitators (not shown) of the recirculating cement mixing system 105 which are driven by fluid motors (not shown) are, in turn, driven by any suitable commercially available cam actuated pump (not shown) mounted on the engine 130. By also driving the agitators or the recirculating cement mixing system 105 from their own fluid power source located on the engine 130 still greater flexibility and control in the recirculating cement mixing system results, thereby allowing a higher quality cement slurry to be produced by the recirculating cement mixing system.

Figure 6:
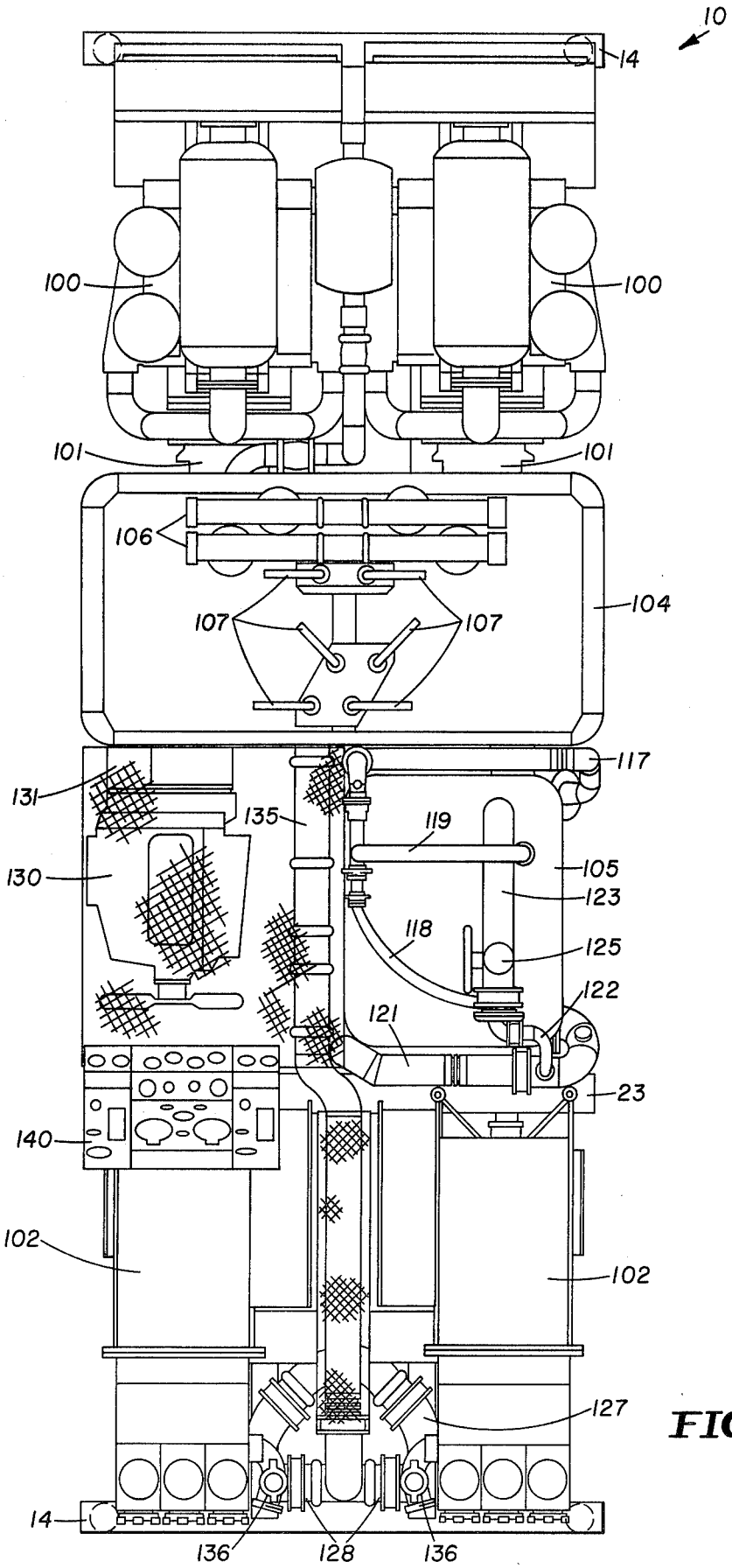
FIG. 6 is a top view of the machinery skid unit as shown in FIG. 4.

Referring to FIG. 6, the relationship of the various major components of the machinery skid unit can be seen. Each positive displacement pump 102 is driven by engine 100 via transmission 101 and drive shaft 103 (see FIG. 4 & FIG. 5). The measuring tank 104, recirculating cement mixing system 105 and operator's platform 134 are mounted between the engines 100 and positive displacement pumps 102 and above auxiliary engine 130, engine drive shafts 103, water supply pump 110 and recirculating mixer pump 112. By arranging the measuring tank 104, recirculating cement mixing system 105 and operator's platform 134 in such a configuration the use of available space on the machinery skid frame 10 is maximized while fluid manifolding problems are minimized and component accessibility for servicing is readily available.

As shown, the suction manifolds 128 of the positive displacement pumps 102 are connected via line 135 and control valves (not shown) to the measuring tank 104. The positive displacement pumps 102 discharge through manifolds 136 which may be connected to any suitable line.

It should be noted that the operation of the various components of the machinery skid unit is well known and understood by those skilled in the art. Therefore, the operation of the components and their interrelationship to each other has not been described herein.

From the foregoing discussion, several advantages of the present invention should be readily apparent.

First, by arranging the longitudinal frame members of the machinery skid frame in close proximity to each other, the cross-members of the skid frame can be easily mounted thereon and extend outwardly therefrom thereby forming a machinery skid frame having a strong central spine and cross-members extending therefrom for the mounting of components thereon and therealong.

By mounting some of the machinery skid unit components above and generally outboard of the longitudinal frame members of the machinery skid frame, the components are easily accessible for servicing and can be compactly arranged on the machinery skid frame thereby minimizing the lengths of fluid lines and manifolds used to connect the various components.

By mounting the water supply pump for the recirculating cement mixing system and the recirculating pump along side on the longitudinal frame member and below the measuring tank and the recirculating cement mixing system, the pumps are readily accessible for servicing, are maintained flooded during pumping operations thereby eliminating almost all cavitation problems experienced by the pumps and are located in the most desirable position on the machinery skid frame to eliminate fluid line and manifolding problems.

By utilizing fluid drives for the water supply pump and recirculating pump, the pumps can be located in the most desirable location on the machinery skid frame and the components mounted thereon to maximize the utilization of space on the machinery skid frame and minimize fluid line and manifolding problems.

By utilizing independent fluid drives for the water supply pump, the recirculating pump and agitators for the recirculating cement mixing system greater flexibility in the control of fluid flow and cement slurry control in the recirculating cement mixing system is established, thereby allowing greater control over the cement mixing process.

By utilizing independent fluid drives for the water supply pump, recirculating pump and agitators of the recirculating cement mixing system a single engine driving a plurality of fluid pumps which are connected with the fluid drives of the various components may be utilized, rather than a plurality of independent engines each directly driving a single component.

By mounting above and generally outboard as well as along side the longitudinal frame members of the machinery skid frame, the components can be more compactly arranged on the machinery skid frame, thereby allowing maximum use of available space on the machinery skid frame thereby resulting in a machinery skid unit which occupies a minimum of space.

By constructing the longitudinal frame members of the machinery skid frame from a plurality of sub-frame members which are releasably secured to each other, the machinery skid frame can be easily disassembled into sections for easy handling and shipping during installation.

While the invention has been described with reference to preferred embodiments, it will be appreciated by those skilled in the art that additions, deletions, modifications and substitutions, or other changes not specifically described herein may be made which fall within the purview of the appended claims.

What is claimed is:

1. A machinery skid frame for use as a cementing skid unit having positive displacement pump means, engine means for driving said positive displacement pump means, and fluid measuring tank means, said machinery skid frame comprising:

a plurality of longitudinal frame members located in close proximity to each other for mounting said positive displacement pump means, said engine means and said fluid measuring tank means thereon, each longitudinal frame member comprising:

a plurality of members releasably secured to each other to facilitate disassembly of said machinery skid frame into a plurality of sections, one section having said positive displacement pump means thereon with a remaining section having said engine means and said fluid measuring tank means thereon;

a plurality of frame cross-members for supporting said engine means thereon located above said plurality of longitudinal frame members at one end thereof, secured thereto, and extending outwardly therefrom;

a plurality of frame cross-members for supporting said fluid measuring tank means thereon located above said plurality of longitudinal frame members, secured thereto, and extending outwardly therefrom; and a plurality of frame cross-members for supporting said positive displacement pump means thereon located above said plurality of longitudinal frame members at the other end thereof, secured thereto, and extending outwardly therefrom.

2. The machinery skid frame of claim 1 further comprising:

a plurality of members secured to said longitudinal frame members, extending therefrom, and mounted in a horizontal plane below said plurality of frame cross-members.

3. A machinery skid unit comprising:

a machinery skid frame including:

a plurality of longitudinal frame members located in close proximity to each other;

a plurality of frame cross-members located above said plurality of longitudinal frame members, secured thereto, and extending outwardly therefrom; and a plurality of members secured to said longitudinal frame members, extending outwardly therefrom, and mounted in a horizontal plane below said plurality of frame cross-members;

a plurality of engines mounted on said skid frame, said plurality of engines including at least one auxiliary engine;

a plurality of positive displacement type pumps mounted on said machinery skid frame at one end thereof while the engines of said plurality of engines driving said plurality of positive displacement pumps are located on the other end of said machinery skid frame;

a fluid measuring tank mounted on said machinery skid frame;

a recirculating mixing system mounted on said machinery skid frame;

a supply pump mounted on said machinery skid frame for supplying fluid from said fluid measuring tank to said recirculating mixing system; and a recirculating pump mounted on said machinery skid frame for discharging fluid from said recirculating mixing system to said plurality of positive displacement type pumps.

4. The machinery skid unit of claim 3 wherein said fluid measuring tank and said recirculating mixing system are mounted on said machinery skid frame between said plurality of positive displacement type pumps and the engines of said plurality of engines driving said plurality of positive displacement type pumps.

5. The machinery skid unit of claim 3 wherein said supply pump and said recirculating pump are mounted on members of said plurality of members secured to said longitudinal frame members of said machinery skid frame.

6. The machinery skid unit of claim 3 wherein said auxiliary engine of said plurality of engines is mounted on members of said plurality of members secured to said longitudinal frame members of said machinery skid frame.

7. The machinery skid unit of claim 3 wherein said supply pump and said recirculating pump are centrifugal type pumps.

8. The machinery skid unit of claim 3 wherein said recirculating pump and said supply pump are driven by hydraulic motors.

9. The machinery skid unit of claim 3 wherein said auxiliary engine drives at least one hydraulic pump.

10. The machinery skid unit of claim 8 wherein said auxiliary engine drives a plurality of hydraulic pumps that are connected to said hydraulic motors which drive said recirculating pump and said supply pump.

11. A machinery skid unit comprising:

a machinery skid frame including:

a plurality of longitudinal frame members located in close proximity to each other;

a plurality of frame cross-members located above said plurality of longitudinal frame members, secured thereto, and extending outwardly therefrom; and a plurality of members secured to said longitudinal frame members, extending therefrom, and mounted in a horizontal plane below said plurality of frame cross-members;

a plurality of engines mounted on said skid frame, said plurality of engines including at least one auxiliary engine, said auxiliary engine being mounted on members of said plurality of members secured to said longitudinal frame members of said machinery skid frame;

a plurality of positive displacement type pumps mounted on said machinery skid frame at one end thereof while the engines of said plurality of engines driving said plurality of positive displacement pumps are located on the other end of said machinery skid frame;

a fluid measuring tank mounted on said machinery skid frame between said plurality of positive displacement type pumps and the engines of said plurality of engines driving said plurality of positive displacement type pumps;

a recirculating mixing system mounted on said machinery skid frame between said plurality of positive displacement type pumps and the engines of said plurality of engines driving said plurality of positive displacement type pumps;

a supply pump mounted on at least one member of said plurality of members secured to said longitudinal frame members of said machinery skid frame; and a recirculating pump mounted on at least one of said plurality of members secured to said longitudinal frame members of said machinery skid frame.

12. A machinery skid frame for use as a cementing skid unit having positive displacement pump means, engine means for driving said positive displacement pump means, fluid measuring tank means, recirculating mixing system means, supply pump means, recirculating pump means and auxiliary engine means for driving said supply pump means and said recirculating pump means, said machinery skid frame comprising:

a plurality of longitudinal frame members located in close proximity to each other for mounting said positive displacement pump means, said engine means, said fluid measuring tank means, said recirculating mixing means, said supply pump means, said recirculating pump means and said auxiliary engine means thereon, each longitudinal frame member comprising:

a plurality of members releasably secured to each other to facilitate disassambly of said machinery skid frame into a plurality of sections, one section having said positive displacement pump means thereon, another section having said fluid measuring tank means, said recirculating mixing means, said recirculating pump means, said supply pump means, and said auxiliary engine means thereon, and a remaining section having said engine means thereon;

a plurality of frame cross-members for supporting said engine means thereon located above said plurality of longitudinal frame members at one end thereof, secured thereto and extending outwardly therefrom;

a plurality of frame cross-members for supporting said fluid measuring tank means thereon located above said plurality of longitudinal frame members, secured thereto, and extending outwardly therefrom;

a plurality of frame cross-members for supporting said recirculating mixing means thereon located above said plurality of longitudinal frame members, secured thereto, and extending outwardly therefrom;

a plurality of frame cross-members for supporting said positive displacement pump means thereon located above said plurality of longitudinal frame members at the other end thereof, secured thereto, and extending outwardly therefrom;

support means for supporting said supply pump means secured to one of said plurality of longitudinal frame members, extending outwardly therefrom, and mounted in a horizontal plane below said plurality of frame cross-members;

support means for supporting said recirculating pump means secured to a longitudinal frame member, extending outwardly therefrom, and mounted in a horizontal plane below said plurality of frame cross-members; and support means for supporting said auxiliary engine means secured to a different longitudinal frame member of said plurality of longitudinal frame members than the longitudinal frame member having said support means for said supply pump means secured thereto, extending outwardly therefrom, and mounted in a horizontal plane below said plurality of frame cross-members.

13. A machinery skid unit for use in well cementing operations comprising:

a machinery skid frame including:

a plurality of longitudinal frame members located in close proximity to each other;

a plurality of frame cross-members located above said plurality of longitudinal frame members, secured thereto, and extending outwardly therefrom; and a plurality of members secured to said longitudinal frame members, extending outwardly therefrom, and mounted in a horizontal plane below said plurality of frame cross-members;

positive displacement pump means mounted on one end of said machinery skid frame;

engine means for driving said positive displacement pump means mounted on the other end of said machinery skid frame;

fluid measuring tank means mounted on said machinery skid frame between said engine means and said positive displacement pump means mounted on said machinery skid frame;

recirculating mixing means mounted on said machinery skid frame between said engine means and said positive displacement pump means mounted on said machinery skid frame;

a supply pump means mounted on said machinery skid frame for supplying fluid from said fluid measuring tank means to said recirculating mixing means;

recirculating pump means mounted on said machinery skid frame for discharging fluid from said recirculating mixing system to said positive displacement pump means; and auxiliary engine means mounted on said machinery skid frame for driving said supply pump means and said recirculating pump means.

14. The machinery skid unit of claim 13 wherein said engine means, said fluid measuring tank means, said recirculating mixing means and said positive displacement pump means are mounted on cross-members of said plurality of frame cross-members of said machinery skid frame.

15. The machinery skid unit of claim 13 further comprising operator platform means located between said engine means and said positive displacement pump means mounted on said machinery skid frame.

16. The machinery skid unit of claim 15 wherein said operator platform means is mounted on cross-members of said plurality of frame cross-members.

17. The machinery skid unit of claim 13 wherein said supply pump means and said recirculating pump means are mounted on members of said plurality of members secured to said longitudinal frame members of said machinery skid frame.

18. The machinery skid unit of claim 13 wherein said auxiliary engine is mounted on members of said plurality of members secured to said longitudinal frame members of said machinery skid frame.

19. The machinery skid unit of claim 13 wherein said supply pump means and said recirculating pump means are mounted on members of said plurality of members which are secured to one of said plurality of longitudinal frame members while said auxiliary engine means is mounted on members of said plurality of members which are secured to another longitudinal frame member of said plurality of longitudinal frame members.

20. The machinery skid unit of claim 15 wherein:

said recirculating mixing means is mounted on said machinery skid frame between said fluid measuring tank means and said positive displacement pump means.

21. The machinery skid unit of claim 20 wherein said operator platform means is mounted on said machinery skid frame between said fluid measuring tank means and said positive displacement pump means adjacent said recirculating mixing means.

22. The machinery skid unit of claim 21 wherein said supply pump means is mounted on a member of said plurality of members with said member being mounted below said fluid measuring tank means on one of said plurality of longitudinal frame members, said recirculating pump means is mounted on a member of said plurality of members with said member being mounted below said recirculating mixing means on the same longitudinal frame member as said supply pump means mounted on said member, and said auxiliary engine means being mounted on members of said plurality of members secured to said longitudinal frame member with said members being mounted below said operator platform means on another longitudinal frame member of said plurality of longitudinal frame members.

23. The machinery skid unit of claim 22 wherein said auxiliary engine drives hydraulic pump means that are connected to hydraulic motor means driving said supply pump means and said recirculating pump means.

24. A machinery skid unit for use in well cementing operations comprising:

a machinery skid frame including:

a plurality of longitudinal frame members located in close proximity to each other;

a plurality of frame cross-members located above said plurality of longitudinal frame members, secured thereto, and extending outwardly therefrom; and a plurality of members secured to said longitudinal frame members, extending outwardly therefrom, and mounted in a horizontal plane below said plurality of frame cross-members;

positive displacement pump means mounted on a plurality of cross-members which are mounted on one end of said plurality of longitudinal frame members of said machinery skid frame;

engine means for driving said positive displacement pump means mounted on a plurality of cross-members which are mounted on the other end of said plurality of longitudinal frame members of said machinery skid frame;

fluid measuring tank means mounted on a plurality of cross-members of said machinery skid frame which are mounted between said positive displacement pump means and said engine means;

recirculating mixing means mounted on a plurality of cross-members of said machinery skid frame which are mounted between said fluid measuring tank means and said positive displacement pump means;

operator platform means mounted on a plurality of cross-members of said machinery skid frame which are mounted between said fluid measuring tank means and said positive displacement pump means and adjacent said recirculating mixing means;

supply pump means mounted on a member of said plurality of members of said machinery skid frame, said member being mounted below said fluid measuring tank means on one of said plurality of longitudinal frame members, said supply pump means being driven by hydraulic motor means;

recirculating pump means mounted on a member of said plurality of members of said machinery skid frame, said member being mounted below said recirculating mixing means on the same longitudinal frame member of said plurality of longitudinal frame members as said supply pump means, said recirculating pump means being driven by hydraulic motor means; and auxiliary engine means mounted on a plurality of members of said plurality of members of said machinery skid frame, said members being mounted below said operator platform means on another longitudinal frame member of said plurality of longitudinal frame members, said auxiliary engine means driving hydraulic pump means which power said hydraulic motor means of said supply pump means and said hydraulic motor means of said recirculating pump means.

* * * * *